US011274899B2

(12) United States Patent
Ell et al.

(10) Patent No.: US 11,274,899 B2
(45) Date of Patent: Mar. 15, 2022

(54) LIMB SUPPORT APPARATUS AND METHOD

(71) Applicant: Hoyt Archery, Inc., Salt Lake City, UT (US)

(72) Inventors: Jeremy J. Ell, Stansbury Park, UT (US); Dan'l J. Anselmo, South Jordan, UT (US); Zak T. Kurtzhals, Herriman, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 760 days.

(21) Appl. No.: 14/815,708

(22) Filed: Jul. 31, 2015

(65) Prior Publication Data

US 2017/0030674 A1 Feb. 2, 2017

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC ..... F41B 5/10; F41B 5/1403; F41B 5/0094; F41B 5/00
See application file for complete search history.

(56) References Cited

U.S. PATENT DOCUMENTS 5,339,790 A * 8/1994 Smith ..... F41B 5/10 124/23.1
5,408,982 A * 4/1995 Doornenbal ..... F41B 5/0005 124/23.1
5,429,106 A 7/1995 Martin et al.
5,720,267 A * 2/1998 Walk ..... F41B 5/10 124/23.1
5,901,692 A * 5/1999 Allshouse ..... F41B 5/105 124/23.1
5,921,227 A * 7/1999 Allshouse ..... F41B 5/105 124/25.6
6,244,259 B1 * 6/2001 Adkins ..... F41B 5/0026 124/23.1
6,758,204 B1 * 7/2004 Goff ..... F41B 5/10 124/25.6

(Continued)

OTHER PUBLICATIONS

Bowtech Guardian, Bowtech Product Guide. 2007.

(Continued)

*Primary Examiner* — John E Simms, Jr.
*Assistant Examiner* — Amir A Klayman
(74) *Attorney, Agent, or Firm* — Dorsey & Whitney LLP

(57) ABSTRACT

Various archery bows with abutting limb support are shown. One bow includes a riser that has a handle portion and first and second riser portions extending from the handle portion. The first riser portion has multiple limb contact surfaces that are spaced apart. The bow also has a first limb with a proximal end portion that has multiple external surfaces that abut and are articulable relative to the limb contact surfaces. This first limb is free-floating against the first riser portion. A second limb and a bowstring are connected to the bow as well. Tension in the bowstring is transferred to the first and second limbs. Limbs such as the first limb store energy across more of the length of the limb, have less concentrated stresses, and can be supported and dampened close to the proximal end of the limb.

38 Claims, 9 Drawing Sheets

(56) References Cited

U.S. PATENT DOCUMENTS

| | | | | |
|---|---|---|---|---|
| 8,047,189 | B2 * | 11/2011 | McPherson | F41B 5/10 124/23.1 |
| 8,347,869 | B2 * | 1/2013 | Sims | F41B 5/10 124/23.1 |
| 8,448,630 | B1 * | 5/2013 | McPherson | F41B 5/1403 124/25.6 |
| 8,453,635 | B1 | 6/2013 | McPherson | |
| 8,459,244 | B2 * | 6/2013 | Yehle | F41B 5/0094 124/23.1 |
| 8,776,770 | B2 * | 7/2014 | Batdorf | F41B 5/10 124/23.1 |
| 2006/0011181 | A1 * | 1/2006 | Andrews | F41B 5/1426 124/23.1 |
| 2008/0127961 | A1 * | 6/2008 | McPherson | F41B 5/10 124/88 |
| 2009/0314271 | A1 * | 12/2009 | Ribi | F41B 5/0005 124/25 |
| 2011/0120436 | A1 * | 5/2011 | Eee | F41B 5/0094 124/25.6 |
| 2014/0041645 | A1 * | 2/2014 | Wasilewski | F41B 5/1426 124/25.6 |
| 2014/0116408 | A1 * | 5/2014 | McPherson | F41B 5/1426 124/25.6 |
| 2014/0283804 | A1 * | 9/2014 | Badgerow | F41B 5/10 124/23.1 |
| 2016/0091273 | A1 * | 3/2016 | Denton | F41B 5/0052 124/23.1 |

OTHER PUBLICATIONS

Bowtech Admiral, Bowtech Product Guide. 2009.
PSE DNA, PSE Archery Product Guide, 2013.
Strothers Vital, Strother Archery Product Guide, 2014.

* cited by examiner

LIMB SUPPORT APPARATUS AND METHOD

TECHNICAL FIELD

The present disclosure generally relates to archery bows and limbs for archery bows.

BACKGROUND

Bows and crossbows have flexible portions called limbs that resiliently store the energy or work done by the archer when the bowstring is drawn. When the bowstring is released, the energy stored in the resilient limbs is released to the bowstring, which launches the projectile with the force generated.

The limb may be referred to as a beam member which generally stores strain energy through controlled displacement of the beam across its length. Many bows, especially compound bows, use limbs that are detachable or otherwise made separate from the bow's handle and riser. The ends of the riser usually have a limb pocket in which the limb is inserted and attached to the riser. Thus, the bow's limbs may be removable or replaceable, such as when a limb is damaged or when the archer wishes to change the stiffness and weight of the bow.

Traditionally, a limb has often been secured to the pocket by a pin or bolt that extends through the limb. This pin or bolt prevents sliding between the limb and pocket. For example, a bolt or pin may extend through an aperture that is positioned transversely through the limb. Other designs include a limb that has lateral notches that are configured to mate with protrusions on an inner surface of the pocket, thereby preventing axial withdrawal of the limb from the pocket due to forces pulling the limb distally as the bow is drawn.

As the bowstring is drawn and the limbs flex, several issues may arise with these traditional securement methods. For example, the bolt, pin, or notches hinder or disable flex in the region of the limb between the proximal end (i.e., the butt end of limb within the end pocket) and the intermediate rocker support (which is positioned between the proximal and distal ends). The limbs are therefore more stiff in that region and effectively have diminished ability to store energy there. Thus, the working length of limb is reduced and stress levels in the rest of the limb may be increased.

A pin or bolt may also mechanically limit translation of the end of the limb and thereby increase loads in the beam that are not efficient for energy storage and recovery. The aperture for a bolt or pin may undesirably concentrate stresses around that area of the limb.

In most cases, the limb is also prevented from rotating about its neutral axis. The principles of beam theory show that internal beam reactions are generally increased when beam rotation is limited by the beam's support methods. The result is a generally higher internal shear force or a higher internal bending moment in a limb, so limb designs are limited due to having to account for increased stress and strain caused by the center of rotation being spaced from the neutral axis. Limbs also tend to "walk" out of a pocket over repeated cycles absent some type of a frictional engagement between the limb and the pocket. This frictional engagement often causes a loss of energy and performance.

There is therefore a need for improvements in limbs and limb securement systems for archery bows.

SUMMARY

One aspect of the present disclosure relates to an archery bow with abutting limb support. The bow may comprise a riser that has a handle portion and first and second riser portions. The first riser portion extends from the handle portion and has a plurality of limb contact surfaces that are spaced apart. The second riser portion extends from the handle portion as well. The bow also comprises a first limb having a proximal end portion that has a plurality of external surfaces. The plurality of external surfaces abut and are articulable relative to the plurality of limb contact surfaces, and the first limb is free-floating against the first riser portion. A second limb is connected to the second riser portion, and a bowstring is connected to the archery bow, wherein tension in the bowstring is transferred to the first and second limbs.

In this bow, the plurality of limb contact surfaces may comprise a proximal limb pocket, with the proximal limb pocket having a proximally-facing surface configured to contact a distally-facing surface of the proximal end portion of the limb. The plurality of external surfaces of the first limb may include at least one bulbous end surface positioned at the proximal end portion of the first limb. The first limb may have a thickness, and the plurality of external surfaces of the first limb may include a proximal end surface having a radius of curvature greater than half of the thickness. The first limb may be seated in the limb pocket by a limb reaction force resulting from the tension in the bowstring. The tension may be transferred to a distal end of the first limb.

In some embodiments, the plurality of external surfaces that abut the plurality of limb contact surfaces may protrude from the first limb. The plurality of limb contact surfaces may be recessed. The plurality of external surfaces may be slidable against the plurality of limb contact surfaces. The plurality of limb contact surfaces may comprise a proximal limb pocket and an intermediate limb pocket, wherein the proximal limb pocket may be positioned to contact a tension surface of the first limb at a proximal end of the first limb, and the intermediate limb pocket may be positioned to contact a compression surface of the first limb at an intermediate portion of the first limb.

The intermediate portion of the first limb that contacts a portion of the plurality of limb contact surfaces may translate proximally upon applying tension to the bowstring, and the proximal end of the first limb may not translate upon applying tension to the bowstring. A surface area of contact between the plurality of external surfaces of the first limb and the plurality of limb contact surfaces of the first riser portion may remain constant throughout a draw cycle of the bowstring. Tension applied by the bowstring may increase engagement forces between the plurality of external surfaces of the first limb and the plurality of limb contact surfaces of the first riser portion.

In another aspect of the disclosure, an archery bow is disclosed that may comprise a handle portion and a first riser portion extending from the handle portion, with the first riser portion having a limb pocket. The bow may also have a first limb comprising a neutral axis positioned within the first limb and a proximal end portion that is rotatable about an axis of rotation. The axis of rotation may intersect the neutral axis, and the first limb may be free-floating against the first riser portion. The bow may also have a second riser portion extending from the handle portion and a second limb connected to the second riser portion. A bowstring may be connected to the archery bow, wherein tension in the bowstring is transferred to the first and second limbs.

This bow may have a limb pocket that has a rounded limb contact surface and the proximal end portion of the first limb may have a rounded pocket contact surface. The rounded limb contact surface may be slidable against the rounded pocket contact surface. A portion of the limb contact surface may contact a distal side of the rounded pocket contact surface of the first limb. In some arrangements, the first limb further comprises an intermediate portion, the first riser portion further comprises an intermediate limb pocket, and the intermediate portion of the first limb abuts the intermediate limb pocket. A distance between the proximal end portion and the intermediate portion of the first limb may decrease as the first limb bends.

A dampening member may be positioned between the proximal end portion and the intermediate portion of the first limb. The tension in the bowstring transferred to the first limb may apply a force proximally driving the proximal end portion along the neutral axis.

Another aspect of the disclosure relates to an archery bow with abutting limb support. The bow may comprise a handle portion and a riser extending from the handle portion, with the riser having a proximal limb pocket and an intermediate limb pocket. A first limb may abut and may be slidable against the proximal and intermediate limb pockets. The first limb may have a limb length, wherein a distance between the proximal limb pocket and the intermediate limb pocket is less than or equal to one third of the limb length. The bow may further include a second limb connected to the riser and may further include a bowstring, wherein tension in the bowstring is transferred to the first and second limbs.

In some configurations, the first limb is free-floating against the proximal and intermediate limb pockets. The first limb may be arranged to bend along the distance between the proximal limb pocket and the intermediate limb pocket. Additionally, a portion of the first limb abutting the intermediate limb pocket may slide proximally when tension in the bowstring is transferred to the first limb.

Yet another aspect of the disclosure relates to an archery bow with abutting limb support that comprises a riser with a handle portion, a first riser portion extending from the handle portion which has a proximal limb pocket, and a second riser portion extending from the handle portion. A first limb that has a proximal end portion may also be included, wherein the proximal end portion has an external surface that abuts and is articulable relative to the proximal limb pocket such that the first limb is free-floating against the proximal limb pocket. A second limb connected to the second riser portion may also be included, and a bowstring may be connected to the archery bow, wherein tension in the bowstring is transferred to the first and second limbs.

In some embodiments, the first riser portion comprises an intermediate limb pocket and the first limb comprises an intermediate portion, with the intermediate portion of the first limb abutting the intermediate limb pocket. The intermediate portion may be free-floating against the intermediate limb pocket. The external surface of the proximal end portion of the first limb may be bulbous.

Still another aspect of the disclosure is a dampened limb support system for an archery bow. The support system may include a riser having a proximal limb support and an intermediate limb support. A limb may be supported by the proximal and intermediate limb supports and may have a span extending between the proximal and intermediate limb supports. A dampening member may contact the span of the limb between the proximal and intermediate limb supports, and the dampening member may be configured to dampen movement of the span of the limb.

The dampening member may be attached to the riser. Tension applied to the limb by a bowstring may decrease engagement between the dampening member and the limb. In some arrangements, a plurality of dampening members are axially spaced along the limb. The dampening member may be positioned on a compression side of the limb and/or may be cantilevered. The dampening members may extend laterally away from the riser.

Yet another aspect of the disclosure is an archery bow having angled limb support. The bow may comprise a riser that has a handle portion, a first riser portion extending from the handle portion, with the first riser portion having a limb contact surface that is tilted at an angle away from the handle portion and laterally away from a centerline of the first riser portion, and a second riser portion extending from the handle portion. A first limb may have an abutting surface contacting the limb contact surface and tilting at the angle of the limb contact surface. A second limb may be connected to the second riser portion, and a bowstring may be connected to the archery bow, wherein tension in the bowstring is transferred to the first and second limbs.

The abutting surface of the first limb may be on an intermediate portion of the first limb, and the limb contact surface of the first riser portion may be on an intermediate support of the first riser portion. The abutting surface and the limb contact surface may be free-floating against each other. The first limb may further comprise a tension surface, wherein the abutting surface of the first limb is positioned non-parallel to the tension surface.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
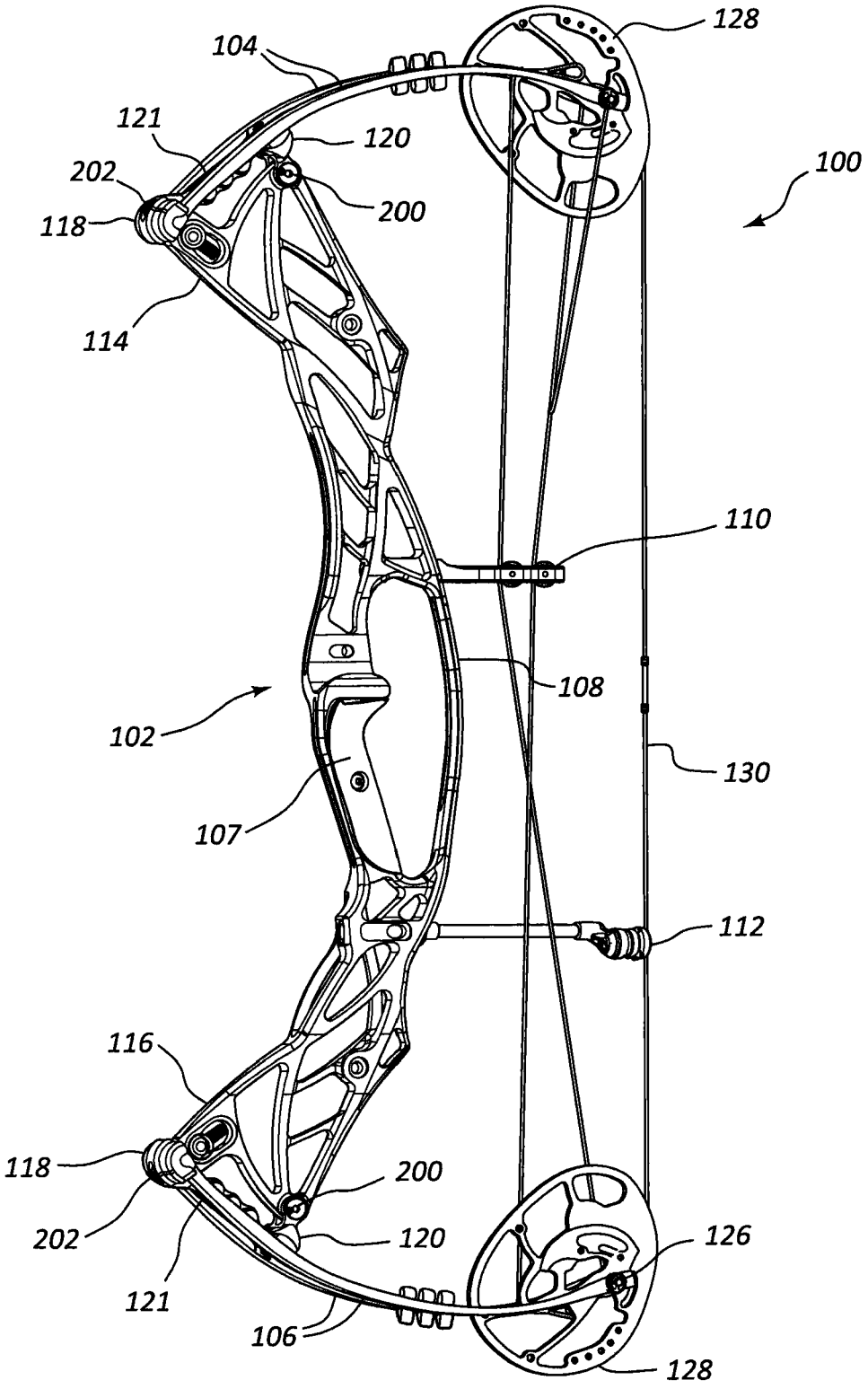
FIG. 1 is a perspective view of a bow according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Aspects of the present disclosure relate to a limb and limb pocket system for an archery bow that may reduce internal stresses in the limb, may improve energy storage ability of portions of the limb that are conventionally underutilized, and may help to keep the limb engaged with the pocket by reducing frictional losses. In one embodiment, an archery bow is provided with a limb pocket in its riser that receives the proximal end portion of at least one limb. The limb may be seated in and also articulable or rotatable relative to the limb pocket. The proximal end portion may have a plurality of external surfaces that contact a plurality of limb contact surfaces on the riser (e.g., within the proximal limb pocket and at an intermediate rocker support/pocket). The limb may be free-floating within the limb pocket and against the first riser.

As used herein, a "free-floating" limb is defined as a limb held to the riser only through tension applied to the limb and resultant forces generated by contact between the external surfaces of the limb and outer surfaces of the riser. In some exemplary embodiments, that tension may be applied to the limb via a wheel, cam, and/or bowstring. The tension may cause the limb to abut surfaces of the riser in such a manner that the abutting surfaces keep the limb secured to the riser without any fasteners, pins, bolts, clamps, or other friction-applying devices that extend through or clamp down the limb. Accordingly, in some cases, when tension is completely released on a free-floating limb, the limb may fall out of limb pockets and may thereby be loosed from the riser without having to remove a separate securing mechanism and without having to remove a pin from a receiving hole. Additionally, a free-floating limb may be able to bend throughout its length and its ends may be able to rotate or slide relative to the riser since there is no fastener or clamping device preventing its movement, just contact between the outer surfaces of the riser and limb. In this way, the limb "floats" and slides while abutting the surfaces of the riser.

The limb and pocket system may, however, comprise surfaces configured to help prevent the limb from slipping out of its seating in the pocket, such as, for example, an at least partially proximally-facing surface that is positioned distal to an at least partially distally-facing surface of the limb. Thus, the surfaces on the riser that contact the limb may provide some mechanical interference to distal withdrawal of the limb from the limb pocket by contact with a portion of the plurality of external surfaces of the proximal end portion. The mechanical interference, however, may still allow the limb to rotate and bend while only sliding in or abutting the pocket. The holding surfaces may also be configured to allow the limb to slip out of contact with them once tension is released on the limb. Thus, they may not lock the limb in place relative to the riser when there is no tension in the limb, or only a light amount of pressure may be needed to remove the limb after tension is released.

Another aspect of limb and pocket systems of the present disclosure relates to the contact surface area between the limb and the surfaces of the riser that are contacted by the limb. The sliding contact between the limb and the riser may permit the contact surface area to remain at least constant throughout a draw cycle of the bowstring. In conventional limb systems, the limb may not slide relative to the riser or, in some cases, the sliding surfaces in contact with the riser may change as the limb bends, even if the limb is held in place by a pin or bolt. A constant, or potentially increasing, contact surface area throughout the loading of the limb may reduce shear and stress concentration in the limb and may help keep retention surfaces in contact throughout the draw cycle.

Another feature of a limb retention system may include a center of rotation at the proximal end of the limb that is on or near a neutral axis of the limb. The neutral axis may longitudinally extend through the thickness of the limb (e.g., between the tension side and compression side of the limb). Some conventional limbs use a pivot center that is outside the limb's thickness, such as on a protrusion extending from the tension surface of the limb. The amount of rotation possible in those limbs is limited by the stiffness or moment of inertia of the limb due to the pivot being away from the neutral axis of the limb. This property has been established, for example, using the well-known parallel axis theorem, which shows that stiffness increases as a function of the square of distance away from the neutral bending axis. When the pivot center is significantly offset from the neutral axis, the limb may axially translate away from the pivot center as it bends. This increases stress at the pivot center and at the limb's supports (e.g., at an intermediate limb support). Accordingly, the present disclosure shows limbs having proximal pivot centers that lie between tension and compression sides of the limbs and/or near the limbs' neutral axes to minimize these effects and to allow the limbs to have more evenly distributed stresses, more consistent stiffness, and less axial translation. Thus, these limbs may have improved reliability and reduced materials specifications.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, methods described may be performed in an order different from that described, and various steps may be added, omitted, or combined. Also, features described with respect to certain embodiments may be combined in other embodiments.

Referring now to the figures in detail, FIG. 1 shows an archery bow 100 according to an embodiment of the present disclosure. The bow 100 comprises a riser 102 from which upper limbs 104 and lower limbs 106 extend. The riser 102 may comprise a handle portion 107 (i.e., a grip), a sight window 108, a cable guard 110, a string dampener 112, and/or other accessories commonly known in the art. The riser 102 has an upper portion 114 and a lower portion 116 each comprising a proximal limb pocket 118 and an intermediate limb pocket 120 for each limb 104, 106. The proximal limb pocket 118 and intermediate limb pocket 120 may be part of an adjustable pocket guide 121. See also FIGS. 2-4 and their descriptions herein.

The limbs 104, 106 each have a proximal end 212 (i.e., a butt end) positioned adjacent to the proximal limb pocket 118 and a distal end 215 (i.e., an outer end) extending away from the proximal limb pocket 118 and connected to an axle 126 on which wheels 128 or cams turn. A bowstring 130 extends between the wheels 128 and provides tension to the wheels 128, and that tension is in turn applied to the limbs 104, 106. In other embodiments, such as in embodiments where the bow is a traditional bow, recurve bow, or crossbow, the bowstring may be directly connected to the distal ends of the limbs 104, 106 and therefore may transfer tension directly to the limbs.

Drawing the bowstring 130 therefore flexes and bends the distal ends 215 of the limbs 104, 106 inward (i.e., toward each other). The energy thereby stored by the limbs 104, 106 is released when the bowstring 130 is released, and the spring of the limbs 104, 106 forcefully straightens them and drives a projectile connected to the bowstring 130 forward at high acceleration and velocity away from the archer and toward a target.

While in this example embodiment a compound archery bow is shown and described, it will be understood that the principles and teachings of the present disclosure are adaptable to many other areas, including, without limitation, crossbows, traditional bows, recurve bows, and other related products. Additionally, while the bow 100 in this example has upper and lower limbs 104, 106 that both have features of the present disclosure, it will be appreciated that in some embodiments only some of the limbs 104, 106 may have the features disclosed herein, with the remaining limbs having conventional features. Thus, the present disclosure is presented to provide examples of ways that principles and features of the limbs of the present disclosure may be implemented without limiting the disclosure to the exact configuration shown.

In some embodiments, the riser 102 may be a single piece having a handle portion 107 and upper and lower riser portions 114, 116, as shown in FIG. 1. In other embodiments the riser 102 may have a multi-piece design, wherein the handle portion 107 may be separable or made of a different assemblable piece from the upper and lower riser portions 114, 116. In either case, the upper and lower riser portions 114, 116 may individually be referred to as a first riser portion and a second riser portion, respectively, or vice versa.

Figure 2:
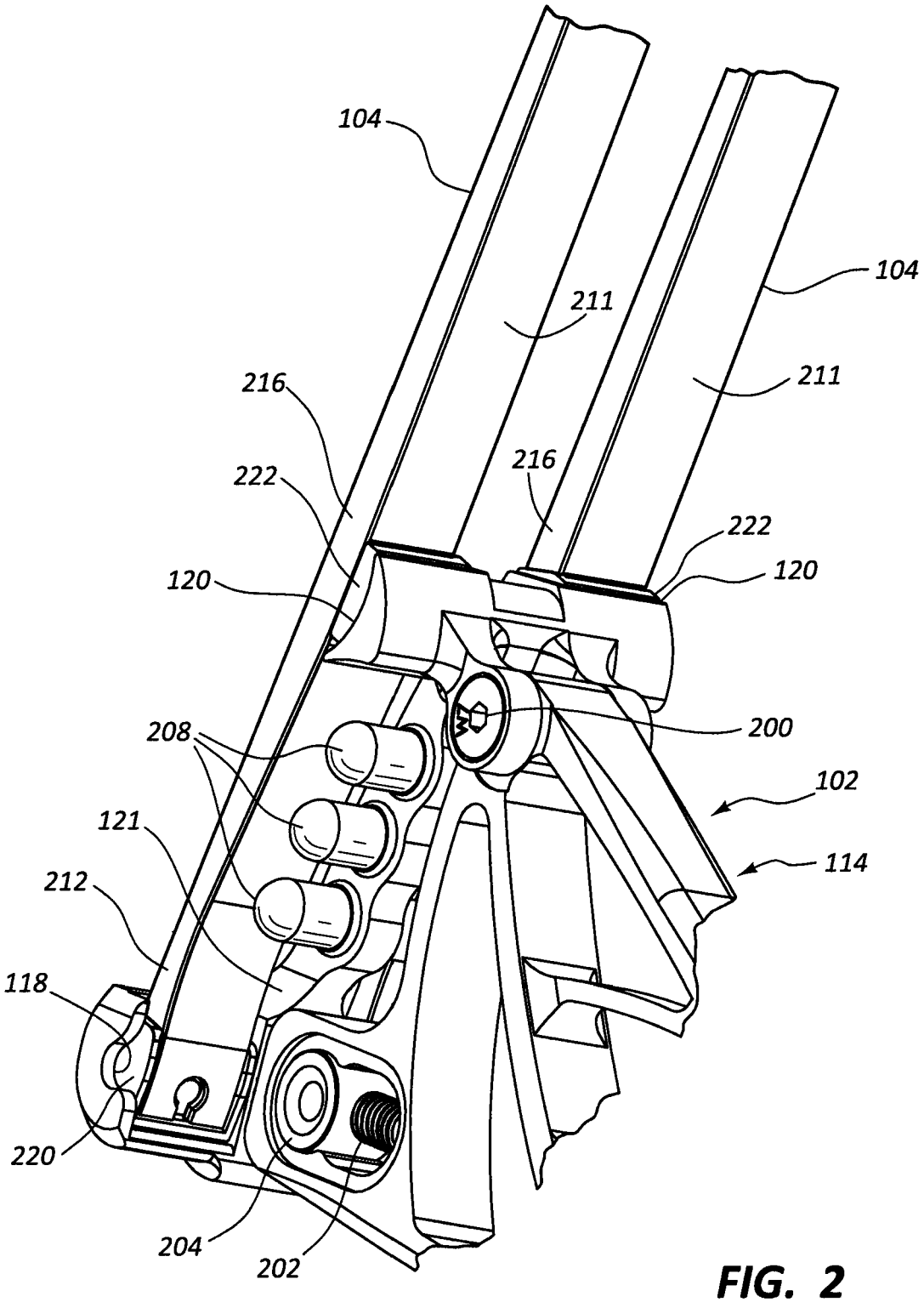
FIG. 2 is a detailed perspective view of the upper end of the riser and lower end of the upper limbs of the bow of FIG. 1.
Figure 3A:
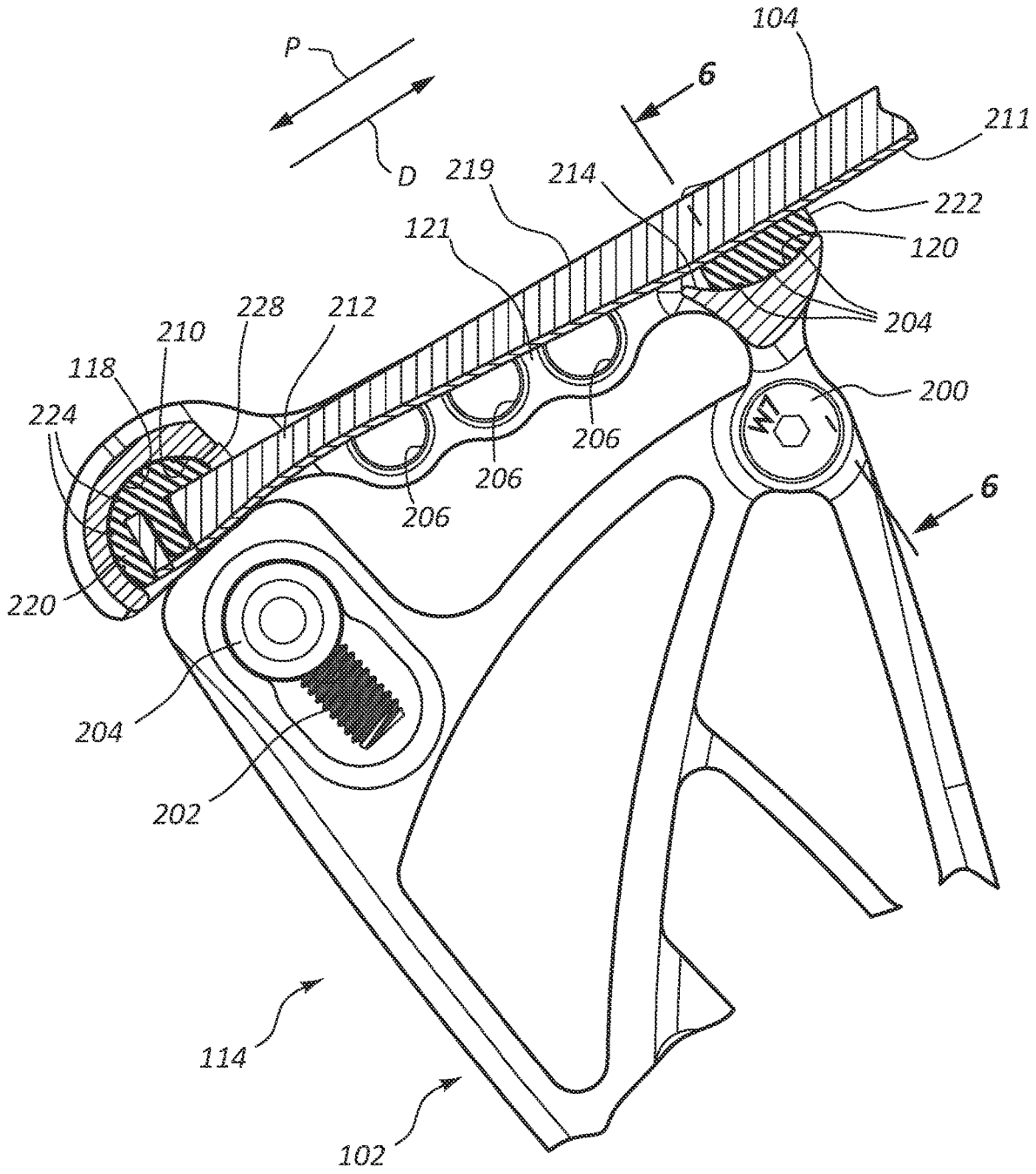
FIG. 3A is a cross-sectional view taken through one of the limbs shown in FIG. 2 when the bowstring is in brace position.
Figure 3B:
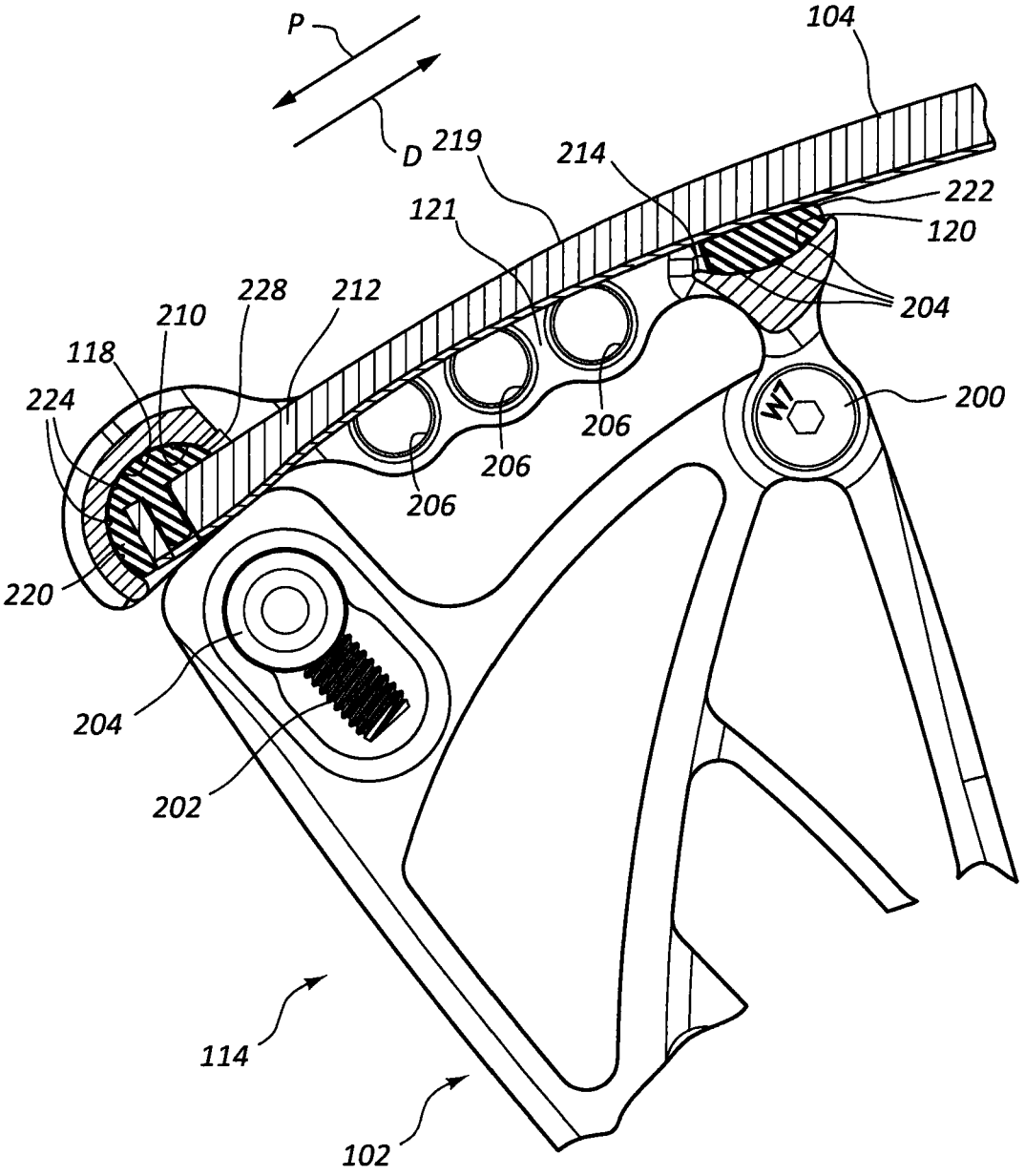
FIG. 3B is a cross-sectional view taken through one of the limbs shown in FIG. 2 when the bowstring is at a full draw position.
Figure 4:
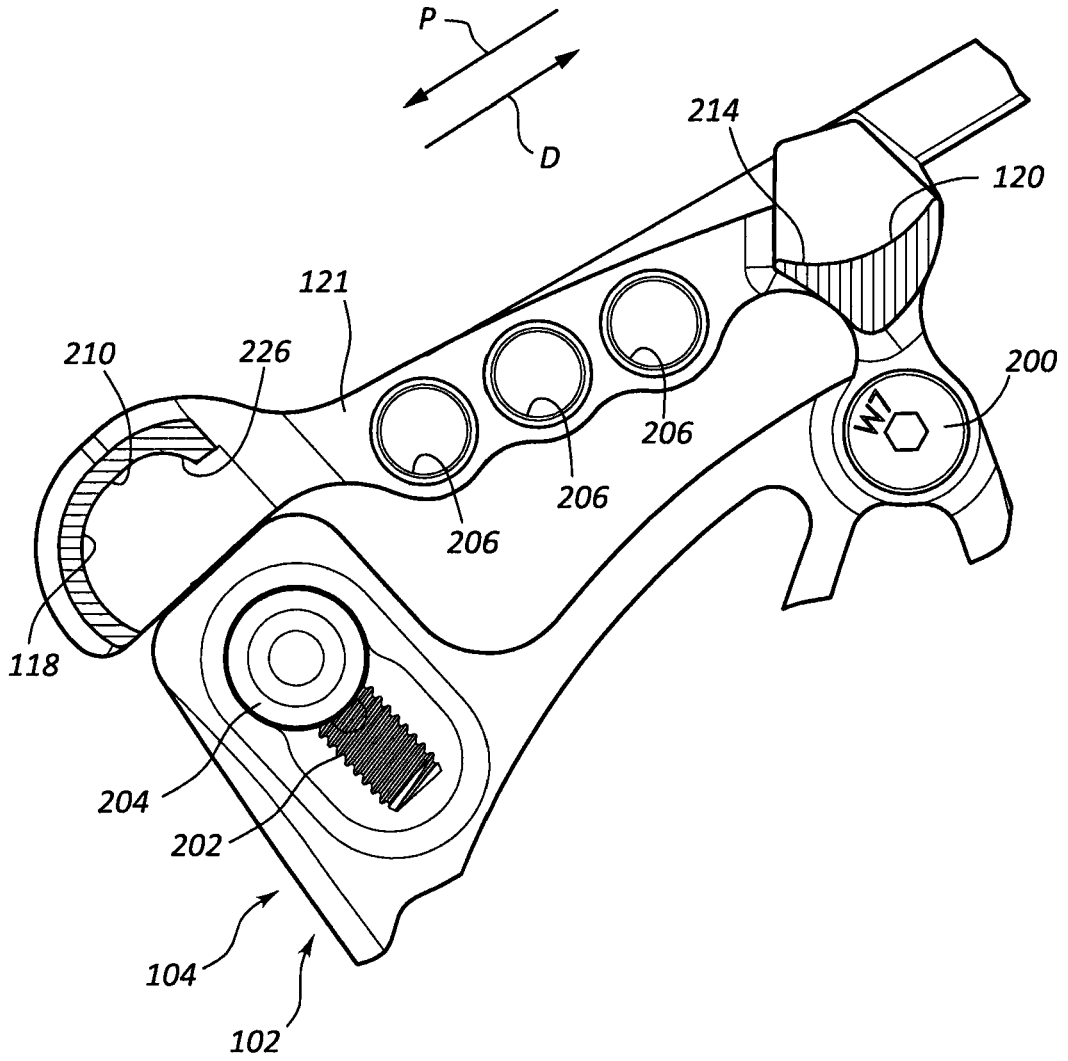
FIG. 4 is the cross-sectional view of FIG. 3A with the limb removed.
Figure 5A:
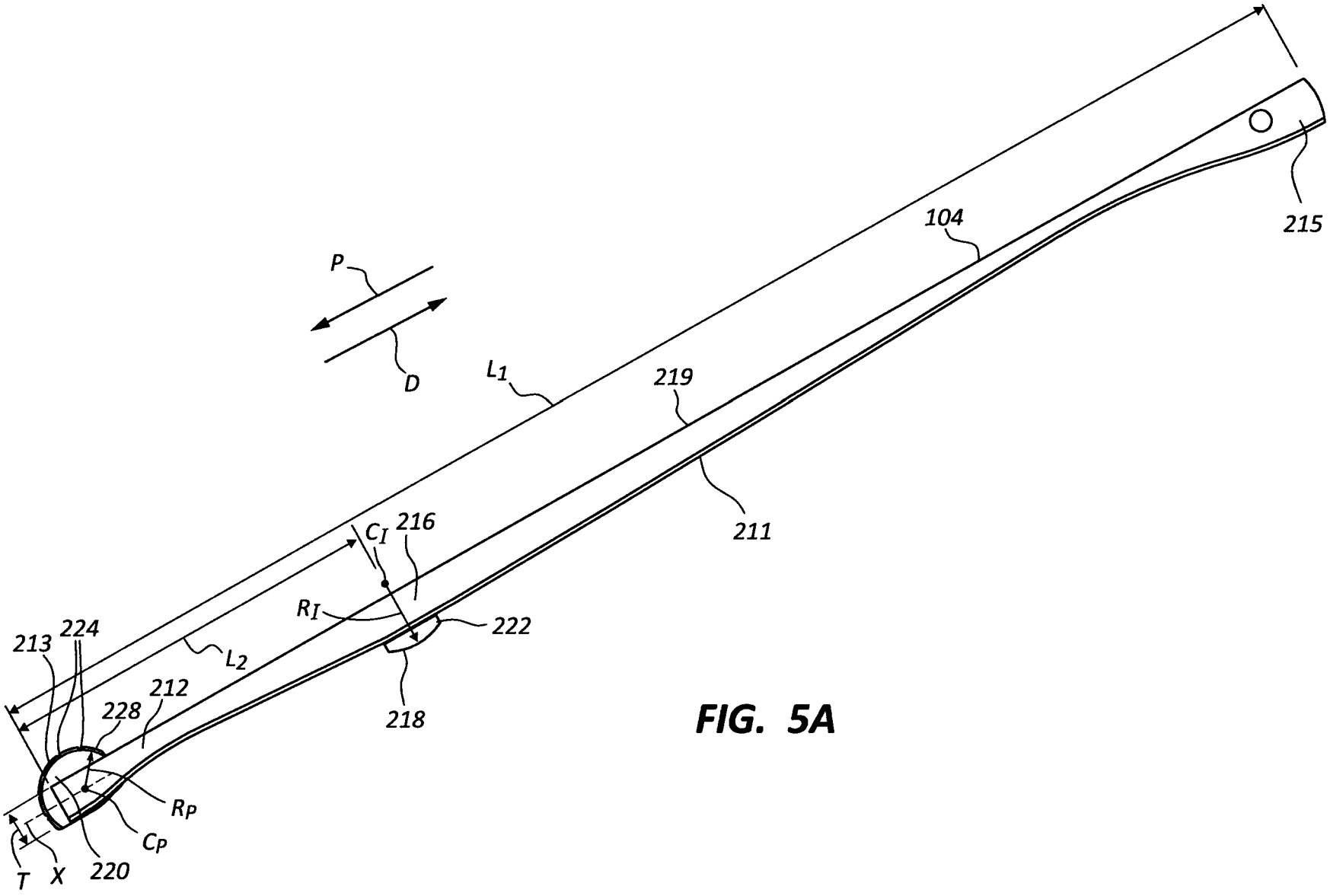
FIG. 5A is a side view of a limb of FIG. 3A separated from the riser and under no tension.
Figure 5B:
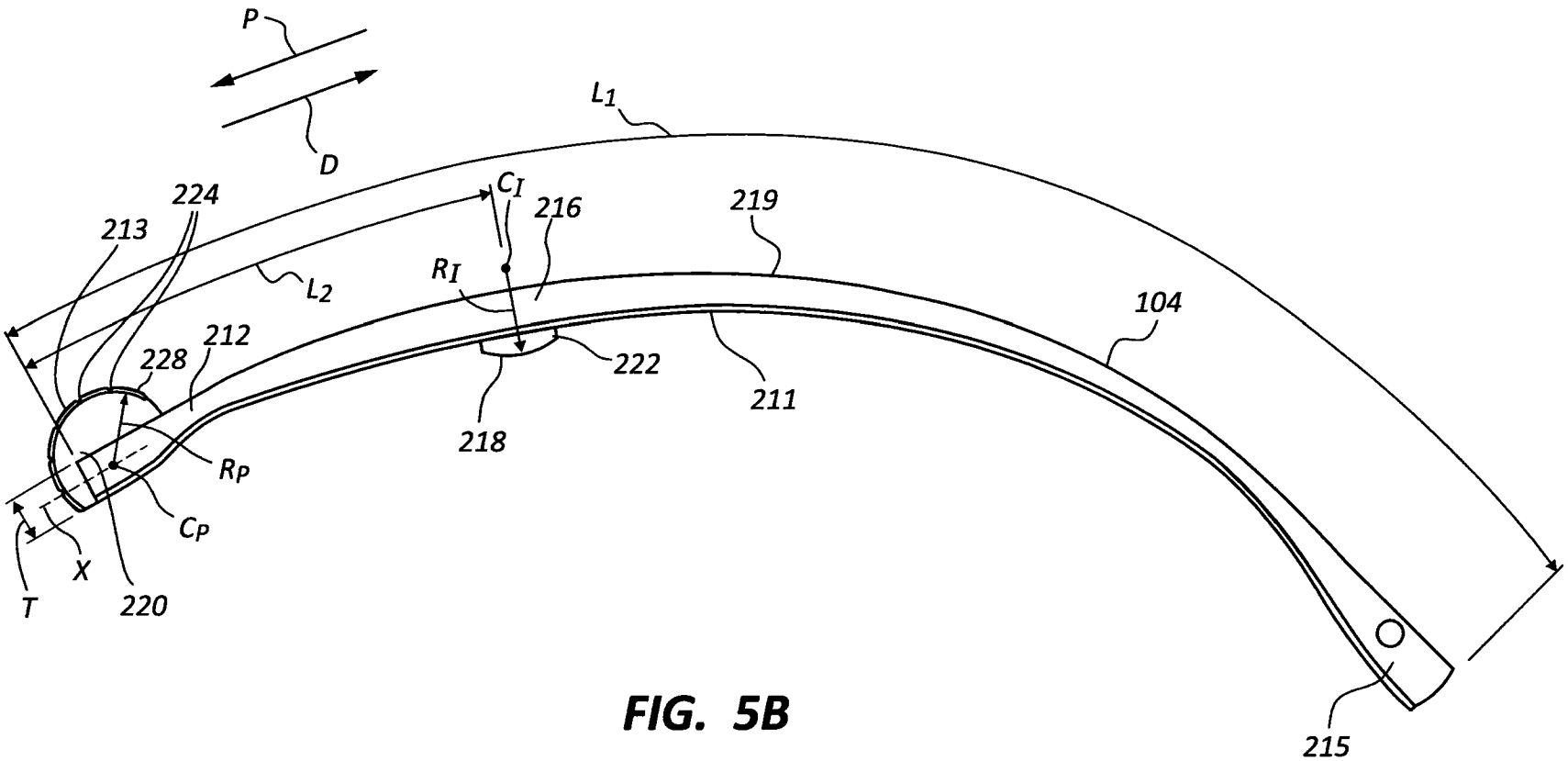
FIG. 5B is a side view of the limb of FIG. 5A as it would appear under tension when the bowstring is at full draw.

FIGS. 2-3B show detailed views of the upper riser portion 114 and the interface between the riser 102, upper limbs 104, and the pocket guide 121. Corresponding structures may be implemented on the other end of the riser 102 (e.g., at the lower riser portion 116 with limbs 106). Thus, features and characteristics of the upper limbs and limb pockets may be implemented at the lower end of the riser 102 as well. Similarly, although only a left side limb 104 is shown in cross-section in the figures, the features and characteristics of this limb may be implemented on the right side of the bow 100. FIG. 2 shows a perspective view and FIGS. 3A-3B show cross-section views taken vertically through one of the upper limbs 104. FIG. 4 shows the section view of FIG. 3A with the left side limb 104 removed. FIG. 5A shows the limb 104 removed from the riser, and FIG. 5B shows the limb of FIG. 5A as it would appear with the bowstring at full draw.

FIGS. 2-4 show the pocket guide 121 connected to the upper riser portion 114. The pocket guide 121 contacts multiple sides of the two upper limbs 104 and is centered between the upper limbs 104. See also FIG. 1. The pocket guide 121 is pivotable relative to the upper riser portion 114 about a pivot axis extending through a pivot bolt 200. The pivoted position of the pocket guide 121 is adjustable after assembly of the bow 100 by adjustment of an adjustment bolt 202 positioned between the proximal limb pockets 118. These bolts 200, 202 are also indicated in FIG. 1. The adjustment bolt 202 is threaded to an adjustment nut 204 that interfaces with the upper riser portion 114 and holds the adjustment bolt 202 in place relative to the riser 102. The adjustment of the pocket guide 121 may enable the archer to fine tune the bow and the angle of the limbs 104 before or after the limbs 104 are assembled. In some embodiments, however, the pocket guide 121 may be integrally connected to, and not adjustable relative to, the riser 102. Whether or not the pocket guide 121 is adjustable relative to the riser 102, the pocket guide 121 may remain rigid and stationary relative to the limbs 104 and riser 102 while shooting the bow 100.

The pocket guide 121 may also comprise a plurality of apertures 206 that may be used to hold dampening members 208. See FIG. 2; FIGS. 3A-4 have the dampening members 208 hidden. The dampening members 208 may be cantilevered members (e.g., shock rods) that extend laterally from the apertures 206 and contact the inside or outside of the limbs 104. As portions of the limbs 104 flex and bend along the span of the limb that extends between the proximal and intermediate limb pockets 118, 120 (i.e., the portion along length $L_2$ shown in FIGS. 5A-5B), such as when the bow 100 is drawn, the dampening members 208 may have less or no contact with the limbs 104. When the limbs 104 return to their resting positions, they may return to their original engagement with the dampening members 208 (i.e., returning to engagement or returning to increased engagement). Thus, when tension is released in the bowstring 130, the dampening members 208 may dampen the movement of the portion of the limbs 104 between the proximal and intermediate limb pockets 118, 120 to reduce vibration, sound, and other undesirable effects. This may be particularly advantageous in connection with the present limbs since conventional limbs have minimal or no bending deflection along the span between proximal and intermediate limb supports. Thus dampening that span in a conventional limb may not provide significant dampening as compared to the limbs of the present disclosure. Vibration and sound would have to be dampened elsewhere in those bows, potentially in parts of those bows that would interfere with the performance of the bow or other attachments or accessories. The dampening members 208 of the present disclosure are positioned in a portion of the bow that would not be conventionally used for other purposes.

The proximal limb pockets 118 are positioned forward of the intermediate limb pockets 120 on the riser 102 along proximal direction P. See FIG. 4. The proximal limb pockets 118 may have a curved inner surface 210 against which a proximal end portion 212 of the limb 104 may abut and slide (see FIGS. 3A-3B). The curved inner surface 210 may have a radius of curvature that generally corresponds with an outer radius $R_P$ (see FIG. 5A) of an outer pivoting surface 213 the proximal end portion 212 of the limb 104. The intermediate limb pockets 120 may also have a curved surface 214 (see FIG. 4) against which an intermediate portion 216 of the limb 104 may abut and slide (see FIGS. 3A-3B). The intermediate portion 216 of the limb 104 may comprise an outer pivoting surface 218 that has curvature corresponding with the curvature of the curved surface 214 of the intermediate limb pocket 120. The curved surfaces 210, 214 of the limb pockets 118, 120 may be recessed or concave and may therefore receive surfaces of the limb 104 into their concavity or recesses.

As shown in FIG. 5A, the proximal center of curvature $C_P$ of the outer pivoting surface 213 is positioned within the thickness T of the limb 104. The proximal radius of curvature $R_P$ may extend between the proximal center of curvature $C_P$ and the outer pivoting surface 213. In some embodiments, the proximal radius of curvature $R_P$ is greater than one-half of the thickness T of the limb 104 (as measured at the proximal center of curvature $C_P$ of the proximal end portion 212 of the limb 104). Thus, the proximal radius of curvature $R_P$ makes the outer pivoting surface 213 protrude from the limb 104. The proximal center of curvature $C_P$ may lie on an axis of rotation of the proximal end portion 212 of the limb 104. In some embodiments, the axis of rotation also lies on or about on the neutral axis of the limb 104. The neutral axis of the limb 104 may be defined as the axis through the limb where longitudinal stress and strain from bending is zero. Stresses in the limb 104 may be minimized by locating the axis of rotation at or near the neutral axis. In FIG. 5A, the neutral axis X extends longitudinally through the limb 104 between the proximal end portion 212 and the distal end 215, and the center of curvature $C_P$ coincides with the axis of rotation. Thus, sliding movement between the outer pivoting surface 213 and the curved inner surface 210 ensures rotation around an axis of rotation that lies on the neutral axis X.

Figure 5C:
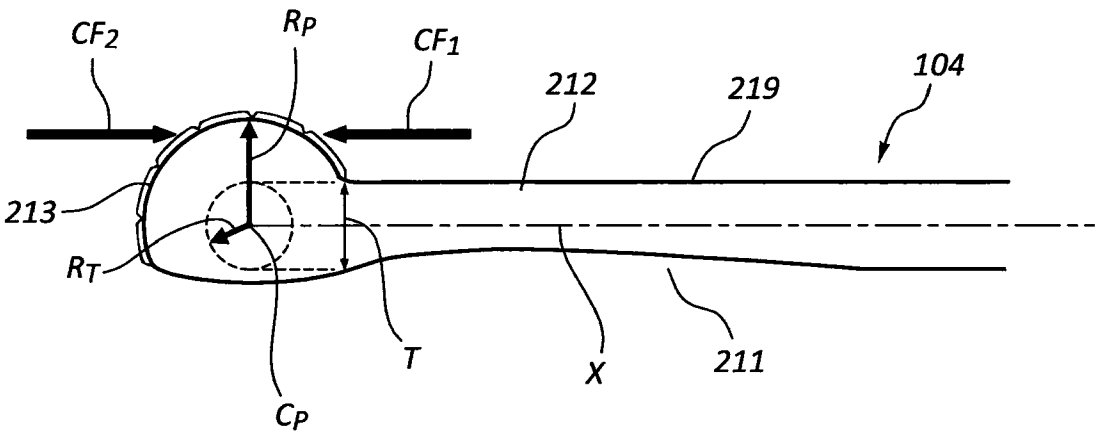
FIG. 5C is a detailed view of the end of the limb of FIG. 5A.

When the proximal radius of curvature $R_P$ is greater than one-half of the thickness T of the limb 104, there is broad surface area at the outer pivoting surface 213 for load support. Additionally, pressure may be applied on both sides of the quadrant around the center of rotation (i.e., center of curvature $C_P$) during draw and letdown. This may encourage proper rotation of the limb 104. Compression between the curved inner surface 210 of the proximal limb pocket 118 and the outer pivoting surface 213 of the proximal end portion 212 of the limb 104 may help keep the limb 104 from slipping or withdrawing from the proximal limb pocket 118. FIG. 5C may help illustrate this function. The proximal end 212 of the limb 104 may have a center of curvature $C_P$ aligned with and/or intersecting the neutral axis X. The proximal radius of curvature $R_P$ extends away from the center of curvature $C_P$ by more than half the thickness T of the limb 104 at the proximal end 212. Thus, when the limb 104 is loaded by a bowstring, reactive containment forces $CF_1$ and $CF_2$ may be applied to the outer pivoting surface 213. These containment forces are applied on both sides of the quadrant around the center for curvature $C_P$, as explained above. When the radius of curvature is less than or equal to half the thickness T of the limb 104 containment forces $CF_1$ and $CF_2$ cannot both be applied to the limb, as made apparent by the broken outline of a limb having radius $R_T$. Thus, a limb having a radius $R_T$ is more prone to being pulled from the proximal limb pocket 118 during draw or letdown since it lacks a protrusion that extends above the tensile surface 219 of the limb 104.

The center of curvature of the curved surface 214 of intermediate limb pocket 120 and the outer pivoting surface 218 may lie outside the thickness of the limb 104. The outer pivoting surface 218 may extend and protrude from a compression surface 211 of the limb 104. FIG. 5A illustrates a center of curvature $C_I$ that is outside the tension surface 219 of the limb 104 at the intermediate portion 216 and opposite the neutral axis of the limb 104 relative to the outer pivoting surface 218 at intermediate portion 216. Thus, the radius $R_I$ of the intermediate portion 216 has a center lying external to the tension surface 219 and radius $R_I$ may be greater than one-half the thickness of the intermediate portion 216 of the limb 104. Additionally, the reaction force at proximal end 212 increases as the limb is bending. This provides increased force of engagement between outer pivoting surface 213 and the abutting distally-facing surface 228 of proximal limb pocket 118, and greater force is required to disengage the components. This proportional curvature relation helps to keep the limb 104 seated in the limb pockets 118, 120 when bending.

In an example embodiment, as the limb 104 bends, the proximal end portion 212 contacts the proximal limb pocket 118, the intermediate portion 216 contacts the intermediate limb pocket 120, and the proximal end portion 212 and intermediate portion 216 both start to rotate around their respective centers of rotation $C_P$, $C_I$. See FIGS. 3A and 3B. Because the intermediate center of curvature $C_I$ is opposite the neutral axis from the outer pivoting surface 218, the proximal end portion 212 of the limb 104 moves proximally (i.e., in direction P) as the limb 104 bends. Thus, bending the limb 104 increases engagement forces between the proximal end portion 212 and the proximal limb pocket 118.

By contrast, bending conventional limbs generates forces that translate their proximal ends distally. One reason that a stress-concentrating pin or axle must be positioned through the limbs is to prevent them from slipping distally and disconnecting from the riser surface. The present limb 104, however, increases engagement with the proximal limb pocket 118 as bending increases, further securing the limb 104 to the riser 102 rather than urging the limb 104 to disconnect from the riser 102 by moving in a distal direction D. This allows the limb 104 to bend more freely with less risk of the limb 104 coming loose, despite the lack of a pinned mechanical device holding the limb 104 to the riser 102.

Sliding engagement at the limb pockets 118, 120 may also accommodate free bending of the limb 104, particularly in the span of the limb (i.e., the portion of the limb 104 extending between the limb pockets 118, 120; see length $L_2$ in FIG. 5A). At rest, there is a first distance between the ends of the span of the limb 104 (e.g., length $L_2$ of FIG. 5A). As the limb 104 bends, the distance between those points decreases due to the increased curvature of the limb 104, as can be seen in FIGS. 3B and 5B. Note, for example, that the intermediate cap 222 slides proximally when the limb 104 changes from the brace condition shown in FIG. 3A to the full-draw condition shown in FIG. 3B, indicating a shortening of the distance between the proximal cap 220 and the intermediate cap 222 and portions of the limb 104 connected to those caps 220, 222. The increased curvature of the limb 104 between the pockets 118, 120 can also be seen by comparing FIGS. 3A and 3B.

In many conventional limbs, the intermediate portion of the limb is pinned to the riser or the proximal end is pinned to the riser through an axis offset from the thickness of the limb. In these cases, the proximal end must withdraw distally to accommodate the shortening of the span as the limb bends. This may reduce engagement between the proximal end and the limb pocket and may make the limb come out of its proximal pocket. Bending in the span is therefore undesirable in those limbs, and they are engineered with a thick span and are rigidly attached to the riser to avoid these issues. This, however, reduces the amount of energy the limb can store since the span is much more rigid than the rest of the limb.

By comparison, embodiments of the present disclosure may allow more bending in the span, and more of the limb can store energy. Limbs 104 of the present disclosure may bend in the span with the intermediate portion 216 translating slightly toward the proximal limb pocket 118 while the proximal end portion 212 does not translate. Thus, the bend is accommodated rather than avoided, and no stress-concentrating pins or axles are required to keep the limb 104 secured to the riser 102 since the external surfaces of the limb 104 and contact surfaces of the riser 102 are pressed toward each other as bending occurs rather than being drawn apart.

A free-floating proximal end portion 212 and sliding intermediate portion 216 may also allow the load of the limb to be more evenly distributed throughout the limb's supports. Also, because the proximal end portion 212 slides and remains in constant contact with the curved inner surface 210 of the proximal limb pocket 118, contact surface area is maintained and stresses are more consistently supported by the proximal end portion 212 during bending of the limb. In conventional limbs, the support surface contact area at their proximal ends can change as the limb bends, so pressure on different parts of their proximal ends can fluctuate significantly in comparison to the consistent (or, in some cases, increasing) surface area provided by limbs of the present disclosure.

In some embodiments, the outer pivoting surfaces 213, 218 may be positioned on components that are separate from the main body of the limb 104. For example, a proximal cap 220 may extend around the proximal end portion 212 of the limb 104 and may have outer pivoting surface 213, and an intermediate cap 222 or slide may have outer pivoting surface 218 and may be positioned around the intermediate portion 216 of the limb 104. In such configurations, the caps 220, 222 may comprise a different material from the main body of the limb 104, such as by comprising a durable, low-friction material (e.g., nylon) instead of a metal or composite (e.g., carbon fiber) that could be used for the main body. In other arrangements, the proximal cap 220 and intermediate cap 222 may be integrated as a single piece with the rest of the body of the limb 104. In other words, the outer surface of the limb 104 may be formed with the outer pivoting surfaces 213, 218 being continuous with the rest of the outer surfaces of the limb 104 or formed as part of the limb 104 itself rather than on caps 220, 222 attached to the limb 104.

The outer pivoting surfaces 213, 218 of the caps 220, 222 may comprise a plurality of transverse grooves 224 (see FIGS. 3A-3B and 5A-5B). The grooves 224 may extend at least partially across the width of the caps 220, 222 and at least partially radially into the outer pivoting surfaces 213, 218. These grooves 224 may decrease the surface area of the limb 104 in contact with the limb pockets 118, 120, thereby decreasing friction. In some embodiments, the grooves 224 may also hold grease or other lubricant to help facilitate sliding articulation between the limb 104 and the riser 102.

The curved inner surface 210 and outer pivoting surface 213 may also be designed to interact in a manner that resists inadvertent removal of the limb 104 from the proximal limb pocket 118 while the limb 104 is mounted to the bow 100 and tension is applied to its distal end 215. The curved inner surface 210 comprises a proximally-facing surface 226 (see FIG. 4) and the outer pivoting surface 213 comprises a distally-facing surface 228 (see FIG. 5A). When the limb 104 is held in the proximal limb pocket 118, at least a portion of the proximally-facing surface 226 contacts the distally-facing surface 228. See FIG. 3A. In this way, the limb 104 is prevented from easy slippage in a distal direction out of the proximal limb pocket 118 since tension in the limb 104 urges the proximal end portion 212 into the proximal limb pocket 118 and the limb 104 would have to bend much more drastically than a bow would cause under normal use for the abutting surfaces 226, 228 to slide out of contact. The contact between these surfaces 226, 228 during letdown of the tension in the limb 104 also helps keep the contact surface area between the limb 104 and riser 102 generally constant, so pressure on the limb has generally constant distribution.

Some conventional limbs have an intermediate support portion that is slidable relative to a riser. When a force is applied to the distal end of those limbs, the limb pivots approximately at the intermediate support portion and a resultant force is generated at the proximal end of the limb. The intermediate support portion is located at about half the length of the limb to make the resultant force about equal to the applied force at the distal end. This is important to those limbs because the distal and proximal ends each have axles extending therethrough. If the resultant force is multiplied due to a leverage effect because the intermediate support portion is positioned at less than half the length from the proximal end to the distal end, the resultant force can cause failure of the proximal end of the limb, especially where the stress-concentrating axle or pin extends through the limb. Otherwise, the limb must be designed to be much bulkier and stiffer at the proximal end in order to withstand the amplified load.

Embodiments of the present disclosure, however, may have limbs 104 with an intermediate support that is closer to the proximal end portion 212 than to the distal end 215 since there are no stress-concentrating pins in the proximal end portion 212. Compared to the overall length $L_1$ of the limb 104 (see FIG. 5A), the span distance $L_2$ from the proximal tip to the intermediate support of the limb 104 may be less than half of $L_1$. In some arrangements, $L_2$ may be about one third of $L_1$ or less. In other embodiments, $L_2$ may be about one fourth of $L_1$ or less. A smaller $L_2$ value means the intermediate radius of curvature $R_I$ can be smaller and more bending can take place in the remainder of the limb 104 between the intermediate support and the distal end 215.

Figure 6:
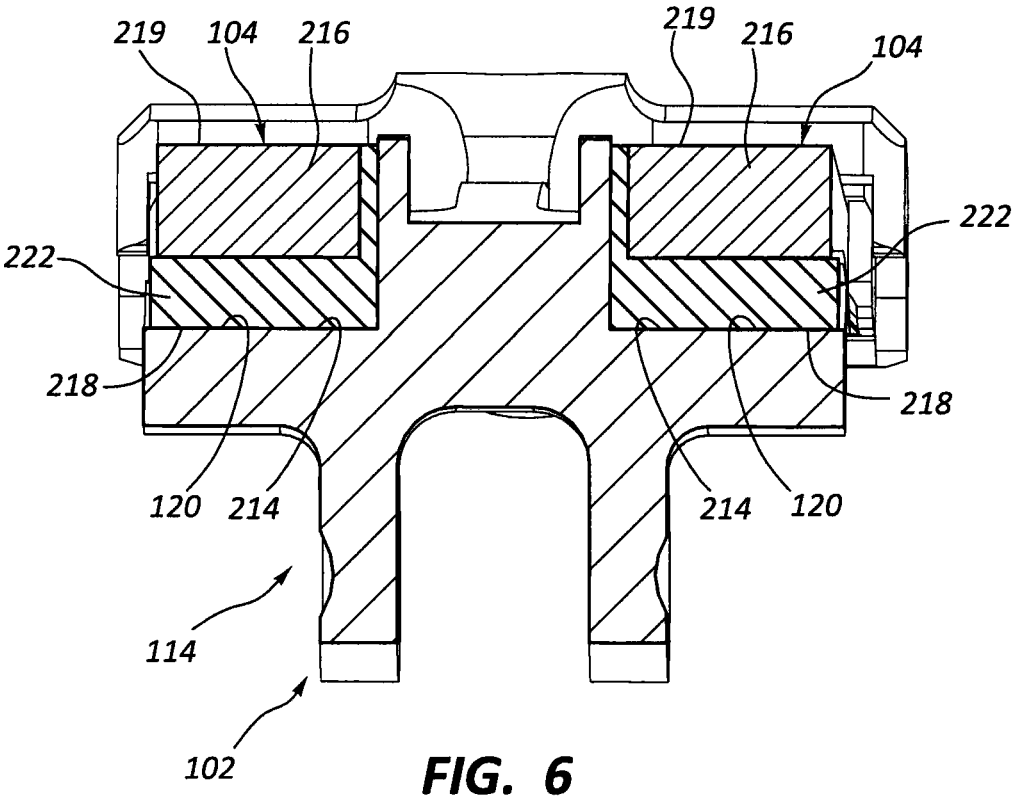
FIG. 6 is a section view of the limbs and riser of FIG. 3A taken through section lines 6-6 in FIG. 3A.

FIG. 6 shows a section view of the limbs 104 and riser 102 of the present disclosure taken through section lines 6-6 shown in FIG. 3A. FIG. 6 shows that the limbs 104 each have a tension surface 219 and an outer pivoting surface 218 (on the caps 222) that extend parallel to each other. The outer pivoting surfaces 218 slide in contact with the limb pockets 120 on the curved surfaces 214 which are also parallel to the tension surfaces 219 and outer pivoting surfaces 218. In some cases, the outer pivoting surfaces 218 may slide laterally relative to the riser 102 (i.e., in a plane parallel to the tension surface 219) when the bow is used.

Figure 7:
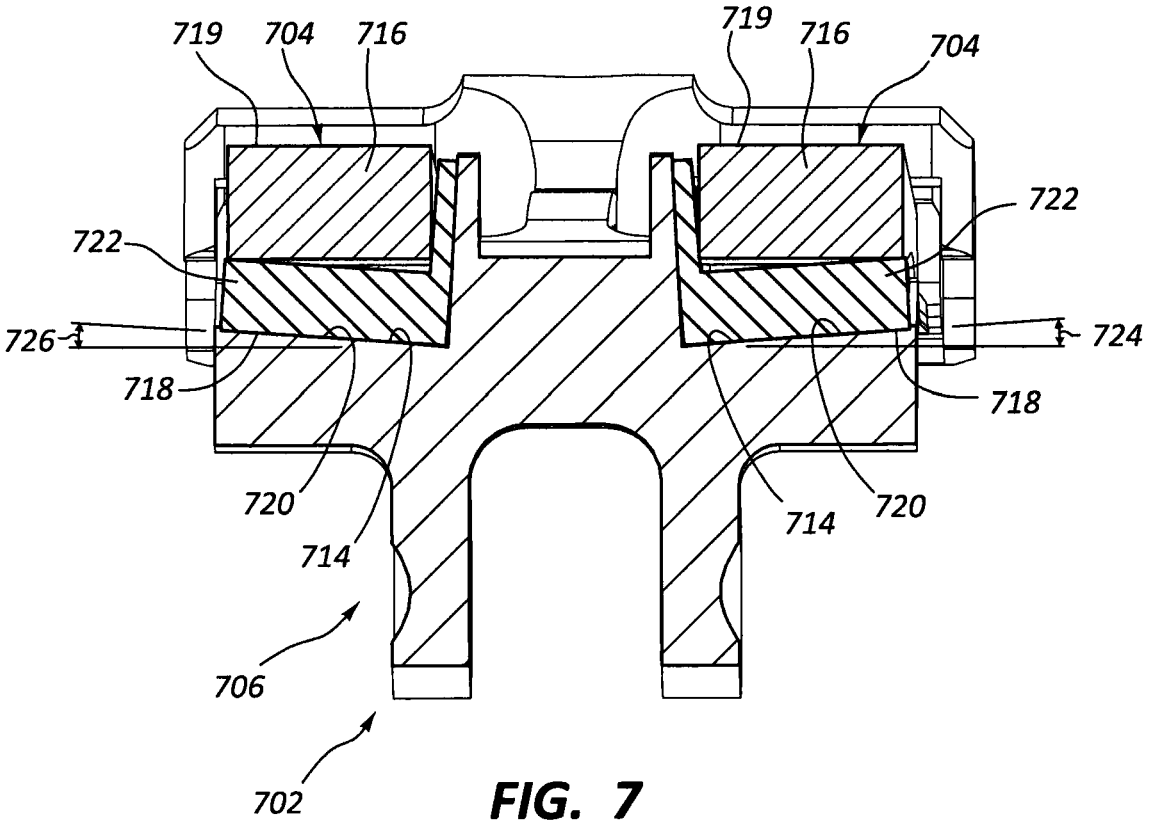
FIG. 7 is a section view of an intermediate portion of the limbs and riser of an alternative embodiment of the present disclosure.

FIG. 7 shows a section view of the same area of a bow according to another embodiment of the disclosure. Here, the riser 702 has an upper portion 706 with an intermediate limb pocket 720 that has a curved surface 714 that is turned at an angle relative to the tension surface 719 at the intermediate portions 716 of the limbs 704. The caps 722 on the limbs 704 are also configured with outer pivoting surfaces 718 that are angled and non-parallel relative to the tension surfaces 719. Thus, the curved surfaces 714 and outer pivoting surfaces 718 abut each other at angles 724, 726 relative to a lateral direction in a horizontal plane (i.e., the plane of the tension surface 719). These angles 724, 726 are nonzero. The angles 724, 726, the curved surfaces 214, and/or the outer pivoting surfaces 718 may be referred to as being "dihedral" in the sense used in aeronautics, wherein the angles 724, 726 or those surfaces extend upward and outward relative to the center of the riser 702 and relative to a horizontal plane through the bow. In other words, the angles 724, 726 or those surfaces may extend away from the handle portion of the bow and laterally outward or horizontally relative to a vertical center plane or centerline of the riser 702 that is centrally positioned between the limbs 704.

The center plane or centerline may bisect the upper portion 706 of the riser between the limbs 704.

In this embodiment, when the limbs 704 are loaded, tension in the limbs 704 drives the caps 722 downward (toward the curved surfaces 714) and inward (toward each other). Thus, the tension increases engagement between the abutting curved surfaces 214 and outer pivoting surfaces 718 and prevents the limbs 704 from sliding laterally away from the riser 702. Instead, the limbs 704 are urged to move toward the centerline of the riser 702. As a result, the limbs 704 may be more predictably loaded and may be less prone to lateral sliding away from the riser 702, even if the caps 722 or intermediate limb pockets 720 begin to wear over time.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow with abutting limb support, comprising:

a riser, comprising:

a handle portion;

a first riser portion extending from the handle portion, the first riser portion having a plurality of limb contact surfaces, the plurality of limb contact surfaces being spaced apart;

a second riser portion extending from the handle portion;

a first limb comprising:

a neutral axis;

a tension surface;

a proximal end portion having a plurality of external surfaces, the plurality of external surfaces abutting and articulable relative to the plurality of limb contact surfaces, wherein the first limb is free-floating against the first riser portion; and an intermediate portion having a pivoting surface, the pivoting surface contacting at least one of the plurality of limb contact surfaces of the first riser portion, the pivoting surface having a center of curvature positioned outside the tension surface and positioned opposite the neutral axis relative to the pivoting surface;

a second limb connected to the second riser portion;

a bowstring connected to the archery bow, wherein tension in the bowstring is transferred to the first and second limbs.

2. The archery bow of claim 1, wherein the plurality of limb contact surfaces comprises a proximal limb pocket, the proximal limb pocket having a proximally-facing surface configured to contact a distally-facing surface of the proximal end portion of the first limb.

3. The archery bow of claim 1, wherein the plurality of external surfaces of the first limb include at least one bulbous end surface positioned at the proximal end portion of the first limb.

4. The archery bow of claim 1, wherein the first limb has a thickness and wherein the plurality of external surfaces of the first limb include a proximal end surface having a radius of curvature greater than half of the thickness.

5. The archery bow of claim 1, wherein the first limb is seated in the plurality of limb contact surfaces by a limb reaction force resulting from the tension in the bowstring, wherein the tension is transferred to a distal end of the first limb.

6. The archery bow of claim 1, wherein the plurality of external surfaces that abut the plurality of limb contact surfaces protrude from the first limb.

7. The archery bow of claim 1, wherein the plurality of limb contact surfaces are recessed.

8. The archery bow of claim 1, wherein the plurality of external surfaces are slidable against the plurality of limb contact surfaces.

9. The archery bow of claim 1, wherein the plurality of limb contact surfaces comprise a proximal limb pocket and an intermediate limb pocket, the proximal limb pocket positioned to contact a tension surface of the first limb at a proximal end of the first limb and the intermediate limb pocket positioned to contact a compression surface of the first limb at an intermediate portion of the first limb.

10. The archery bow of claim 9, wherein the intermediate portion of the first limb contacting a portion of the plurality of limb contact surfaces translates proximally and the proximal end of the first limb does not translate upon applying tension to the bowstring.

11. The archery bow of claim 1, wherein a surface area of contact between the plurality of external surfaces of the first limb and the plurality of limb contact surfaces of the first riser portion is constant throughout a draw cycle of the bowstring.

12. The archery bow of claim 1, wherein tension applied by the bowstring increases engagement forces between the plurality of external surfaces of the first limb and the plurality of limb contact surfaces of the first riser portion.

13. An archery bow, comprising:

a handle portion;

a first riser portion extending from the handle portion, the first riser portion having a limb pocket;

a first limb comprising:

a neutral axis positioned within the first limb;

a proximal end portion being rotatable about an axis of rotation relative to the limb pocket, the axis of rotation intersecting the neutral axis, the first limb being free-floating against the limb pocket of the first riser portion;

a second riser portion extending from the handle portion;

a second limb connected to the second riser portion;

a bowstring connected to the archery bow, wherein tension in the bowstring is transferred to the first and second limbs.

14. The archery bow of claim 13, wherein the limb pocket has a rounded limb contact surface and wherein the proximal end portion of the first limb has a rounded pocket contact surface, the rounded limb contact surface being slidable against the rounded pocket contact surface.

15. The archery bow of claim 14, wherein a portion of the limb contact surface contacts a distal side of the rounded pocket contact surface of the first limb.

16. The archery bow of claim 13, the first limb further comprising an intermediate portion, the first riser portion further comprising an intermediate limb pocket, the intermediate portion of the first limb abutting the intermediate limb pocket.

17. The archery bow of claim 16 wherein a distance between the proximal end portion and the intermediate portion of the first limb decreases as the first limb bends.

18. The archery bow of claim 16, wherein a dampening member is positioned between the proximal end portion and the intermediate portion of the first limb.

19. The archery bow of claim 13, wherein the tension in the bowstring transferred to the first limb applies a force proximally driving the proximal end portion along the neutral axis.

20. An archery bow with abutting limb support, comprising:

a handle portion;

a riser extending from the handle portion, the riser having a proximal limb pocket and an intermediate limb pocket, the riser having at least one dihedral limb-contacting surface;

a first limb abutting and being slidable against the proximal and intermediate limb pockets, the first limb having a limb length, wherein a distance between the proximal limb pocket and the intermediate limb pocket is less than or equal to one third of the limb length, wherein the at least one dihedral limb-contacting surface is angled upward relative to a lateral direction, the lateral direction being substantially perpendicular to the limb length and extending laterally away from a center plane of the riser;

a second limb connected to the riser;

a bowstring connected to the archery bow, wherein tension in the bowstring is transferred to the first and second limbs.

21. The archery bow of claim 20, wherein the first limb is free-floating against the proximal and intermediate limb pockets.

22. The archery bow of claim 20, wherein the first limb is configured to bend along the distance between the proximal limb pocket and the intermediate limb pocket.

23. The archery bow of claim 20, wherein a portion of the first limb abutting the intermediate limb pocket slides proximally when tension in the bowstring is transferred to the first limb.

24. An archery bow with abutting limb support, comprising:

a riser, comprising:

a handle portion;

a first riser portion extending from the handle portion, the first riser portion having a first proximal limb pocket and a second proximal limb pocket, the first proximal limb pocket being laterally offset from the second proximal limb pocket in a direction perpendicular to a vertical center plane of the riser;

a second riser portion extending from the handle portion;

an adjustment fastener positioned laterally between the first and second proximal limb pockets of the first riser portion, the adjustment fastener being configured to adjust the position of the first and second proximal limb pockets relative to the riser;

a first limb comprising:

a neutral axis;

a proximal end portion having an external surface, the external surface abutting and being articulable relative to the first proximal limb pocket, wherein the first limb is free-floating against the first proximal limb pocket;

an intermediate pivoting surface having a center of curvature positioned external to a tension surface of the first limb and opposite the neutral axis relative to the intermediate pivoting surface;

a second limb connected to the second riser portion;

a bowstring connected to the archery bow, wherein tension in the bowstring is transferred to the first and second limbs.

25. The archery bow of claim 24, wherein the first riser portion comprises an intermediate limb pocket and the first limb comprises an intermediate portion, the intermediate portion of the first limb abutting the intermediate limb pocket.

26. The archery bow of claim 25, wherein the intermediate portion is free-floating against the intermediate limb pocket.

27. The archery bow of claim 24, wherein the external surface of the proximal end portion of the first limb is bulbous.

28. A dampened limb support system for an archery bow, the support system comprising:

a riser having a proximal limb support and an intermediate limb support;

a limb supported by the proximal and intermediate limb supports, the limb having a span extending between the proximal and intermediate limb supports;

a dampening member contacting the span of the limb between the proximal and intermediate limb supports, the dampening member configured to dampen movement of the span of the limb, wherein the proximal limb support, the intermediate limb support, and the dampening member contact the span of the limb at separate locations.

29. The dampened limb support system of claim 28, wherein the dampening member is attached to the riser.

30. The dampened limb support system of claim 28, wherein tension applied to the limb by a bowstring decreases or eliminates contact between the dampening member and the limb.

31. The dampened limb support system of claim 28, wherein a plurality of dampening members are spaced along a longitudinal length of the limb.

32. The dampened limb support system of claim 28, wherein the dampening member is positioned on a compression side of the limb.

33. The dampened limb support system of claim 28, wherein the dampening member is cantilevered.

34. The dampened limb support system of claim 28, wherein the dampening member extends laterally away from the riser.

35. An archery bow having angled limb support, the bow comprising:

a riser, comprising:

a handle portion;

a first riser portion extending from the handle portion, the first riser portion having a limb contact surface, the limb contact surface being oriented at an angle directed away from the handle portion and laterally away from a vertical center plane of the first riser portion;

a second riser portion extending from the handle portion;

a first limb having an abutting surface, the abutting surface contacting the limb contact surface and tilting at the angle of the limb contact surface;

a second limb contacting the first riser portion, the first and second limbs being positioned on opposite lateral sides of the vertical center plane;

a third limb connected to the second riser portion;

a bowstring connected to the archery bow, wherein tension in the bowstring is transferred to the first and second limbs.

36. The archery bow of claim 35, wherein the abutting surface of the first limb is on an intermediate portion of the first limb and the limb contact surface of the first riser portion is on an intermediate support of the first riser portion.

37. The archery bow of claim 35, wherein the abutting surface and the limb contact surface are free-floating against each other.

38. The archery bow of claim 35, wherein the first limb further comprises a tension surface, wherein the abutting surface of the first limb is positioned non-parallel to the tension surface.

* * * * *